US008567456B1

(12) United States Patent
Francis

(10) Patent No.: US 8,567,456 B1
(45) Date of Patent: Oct. 29, 2013

(54) ATTACHABLE FUNNEL WITH INTERNAL STRAINER

(76) Inventor: Michael D. Francis, Grand Ridge, FL (US)

( * ) Notice: Subject to any disclaimer, the term of this patent is extended or adjusted under 35 U.S.C. 154(b) by 0 days.

(21) Appl. No.: 13/586,925

(22) Filed: Aug. 16, 2012

(51) Int. Cl.
*B67C 11/02* (2006.01)

(52) U.S. Cl.
CPC ..... *B67C 11/02* (2013.01)
USPC ..... 141/332; 141/286; 141/300; 141/340; 141/383

(58) Field of Classification Search
USPC ..... 141/297, 299, 300, 331, 332, 340, 286, 141/383
See application file for complete search history.

(56) References Cited

U.S. PATENT DOCUMENTS

| | | | | | |
|---|---|---|---|---|---|
| 559,905 | A | | 5/1896 | Pike | |
| 618,996 | A | * | 2/1899 | Riedel et al. | 210/472 |
| 4,170,252 | A | * | 10/1979 | Peterson | 141/331 |
| 4,273,166 | A | * | 6/1981 | Bradley | 141/95 |
| 4,823,848 | A | | 4/1989 | Sentmore et al. | |
| 4,856,568 | A | | 8/1989 | Murphy et al. | |
| 5,219,006 | A | * | 6/1993 | Bishop | 141/1 |
| 5,389,253 | A | * | 2/1995 | Cicconi | 210/248 |
| 5,472,025 | A | * | 12/1995 | Conrad et al. | 141/332 |
| 5,676,185 | A | * | 10/1997 | Starr et al. | 141/300 |
| 5,787,944 | A | | 8/1998 | Sarkis et al. | |
| 5,792,356 | A | | 8/1998 | Yuan | |
| 6,035,907 | A | * | 3/2000 | DeCoster | 141/331 |
| 6,425,424 | B1 | * | 7/2002 | Ellis Calvo et al. | 141/331 |
| 7,137,419 | B1 | * | 11/2006 | Reeves | 141/340 |
| 7,661,538 | B1 | * | 2/2010 | Zuk, Jr. | 210/416.1 |

* cited by examiner

*Primary Examiner* — Timothy L Maust
*Assistant Examiner* — Timothy P Kelly
(74) *Attorney, Agent, or Firm* — Montgomery Patent & Design; Robert C. Montgomery

(57) ABSTRACT

An attachable funnel with internal strainer is used to transfer and strain fluids, such as used cooking oil, from one container to another container for storage and reuse. The funnel includes an insertable screen strainer to filter out food particles and other contaminants from the contaminated fluid. The base of the funnel includes a collar having a plurality of threaded attachment rings to allow the funnel to be screwed onto a storage container. The threaded attachment allows the funnel to remain securely in place on a mouth of the container without risk of tipping or spilling. Integral vent tubes are provided to allow air to escape from the container.

15 Claims, 3 Drawing Sheets

ATTACHABLE FUNNEL WITH INTERNAL STRAINER

RELATED APPLICATIONS

Not Applicable.

FIELD OF THE INVENTION

The present invention relates generally to funnels, and in particular, to a self-venting funnel having a removable internal strainer and an attachment collar for threaded connection to a mouth of a container.

BACKGROUND OF THE INVENTION

Fried foods such as fried turkey, fish, chicken, vegetables, and funnel cakes are among the favorite foods of people worldwide. Their taste coupled with the crispy exterior texture makes them hard to resist. Such foods typically require complete immersion in hot cooking oil to complete the frying process. When complete, the user is left with a large quantity of cooking oil that can be stored and reused. This typically means transfer of the cooking oil to another container for storage.

However, the user must remove any fried food remnants or other contaminants from the cooking oil to prevent contamination and spoilage. Additionally, it is very difficult to pour the oil back into a container due to its heavy consistency. While a standard funnel can be used, the trapped or displaced air from the container being filled must pass though the liquid, not only causing "gurgling" and possible splashing, but a slow fill rate as well. Accordingly, there exists a need for a means by which used cooking oil can be easily transferred, filtered, and stored without the disadvantages as described above.

SUMMARY OF THE INVENTION

In view of these identified disadvantages, the inventor has recognized a lack in the art and observed that there is a need for an attachable funnel with internal strainer for straining and transferring used cooking oil to storable container for reuse. The development of the present invention, which will be described in greater detail herein, substantially departs from conventional solutions to provide a new self-venting attachable strainer funnel and in doing so fulfills this need.

In accordance with features and aspects of one (1) exemplary embodiment consistent with the principles of the present disclosure, an attachable funnel with internal strainer is provided that can include a funnel body having an open top to receive a fluid, a substantially conical funnel side wall, and an open bottom. A spout is affixed about the funnel body open bottom and is in fluid communication with an interior of the funnel body to discharge the fluid. A removable strainer is provided having an open top, a substantially conical strainer side wall, and a strainer bottom insertable within the funnel body interiorly oriented to and axially aligned with the funnel body side wall. A collar is affixed to a lower end of the funnel side wall circumscribing the spout and is configured to attach to a mouth of a container. An annular vent slot is disposed around the spout in fluid communication with an interior of the container. At least one (1) hollow vent tube is provided in fluid communication with the vent slot to provide a fluid passage way extending from the vent slot to the funnel body open top. The vent tube includes an air entrance aperture disposed at a lower end in fluid communication with the vent slot and an air exit aperture disposed at an upper end defining the fluid passage way.

In accordance with features and aspects of one (1) exemplary embodiment consistent with the principles of the present disclosure, the collar comprises includes a plurality of container attachment rings each having a progressively larger length corresponding to said progressively greater diameter. A first container attachment ring circumscribes the spout and has a threaded first inner surface for threaded attachment to a small mouth of a first container. A second container attachment ring circumscribes the first container attachment ring and has a length and diameter greater than the first container attachment ring and a threaded second inner surface for threaded attachment to a medium mouth of a second container. A third container attachment ring circumscribes the second container attachment ring and has a length and diameter greater than the second container attachment ring and a threaded third inner surface for threaded attachment to a large mouth of a third container.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

| | |
|---|---|
| 10 | attachable funnel with internal strainer |
| 20 | funnel body |
| 22a | first vent tube |
| 22b | second vent tube |
| 24a | exit aperture |
| 24b | entrance aperture |
| 26 | funnel top opening |
| 30 | collar |
| 32 | spout |
| 34 | vent slot |
| 36 | first container attachment ring |
| 38 | second container attachment ring |
| 40 | third container attachment ring |
| 60 | strainer |
| 62 | strainer top opening |
| 63 | strainer bottom |
| 64 | open-mesh material |
| 100 | container |
| 110 | fluid |

DETAILED DESCRIPTION OF THE PREFERRED EMBODIMENT

Figure 1:
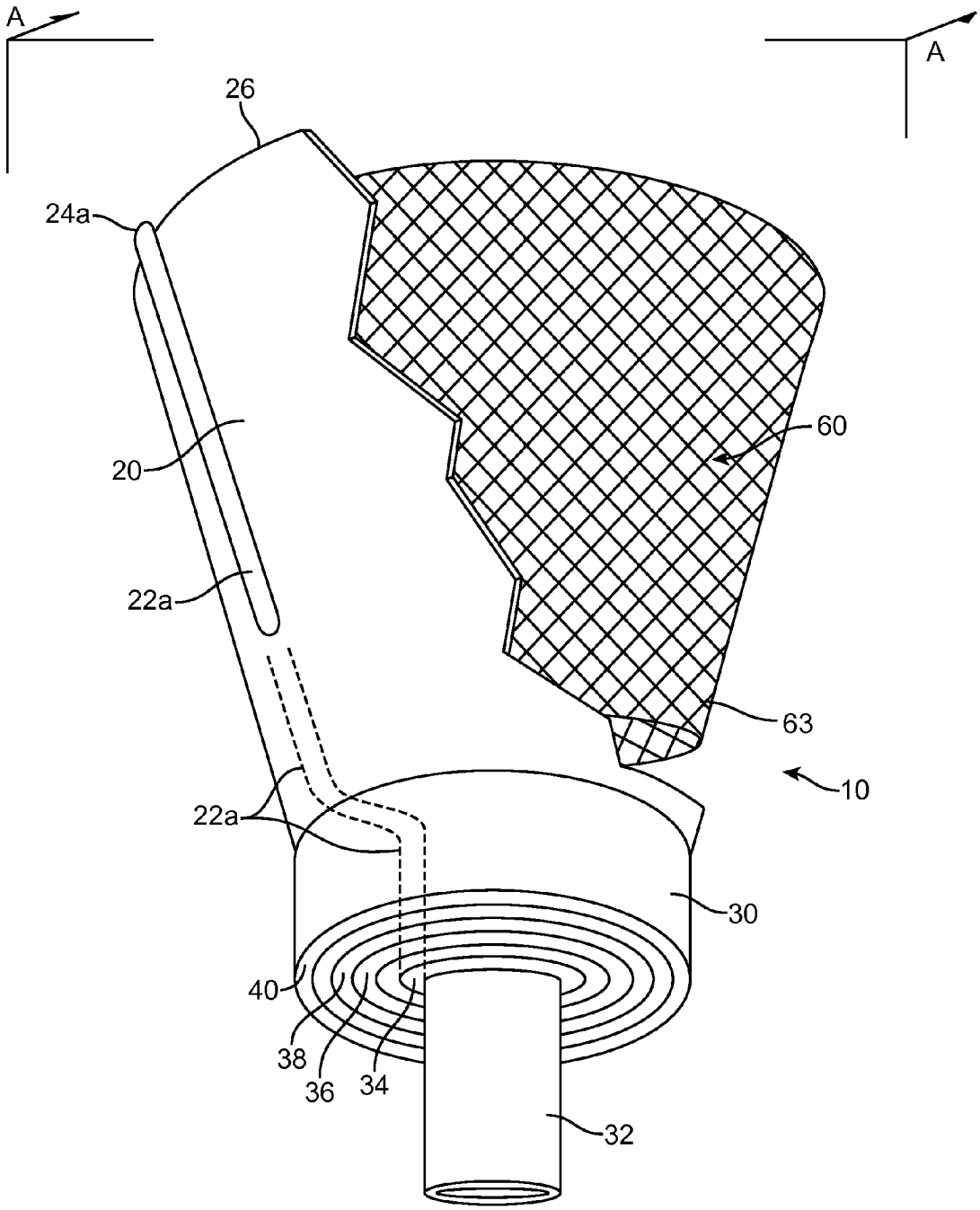
FIG. 1 is a partial cut-away side view of a attachable funnel with internal strainer, in accordance with the present invention.
Figure 2:
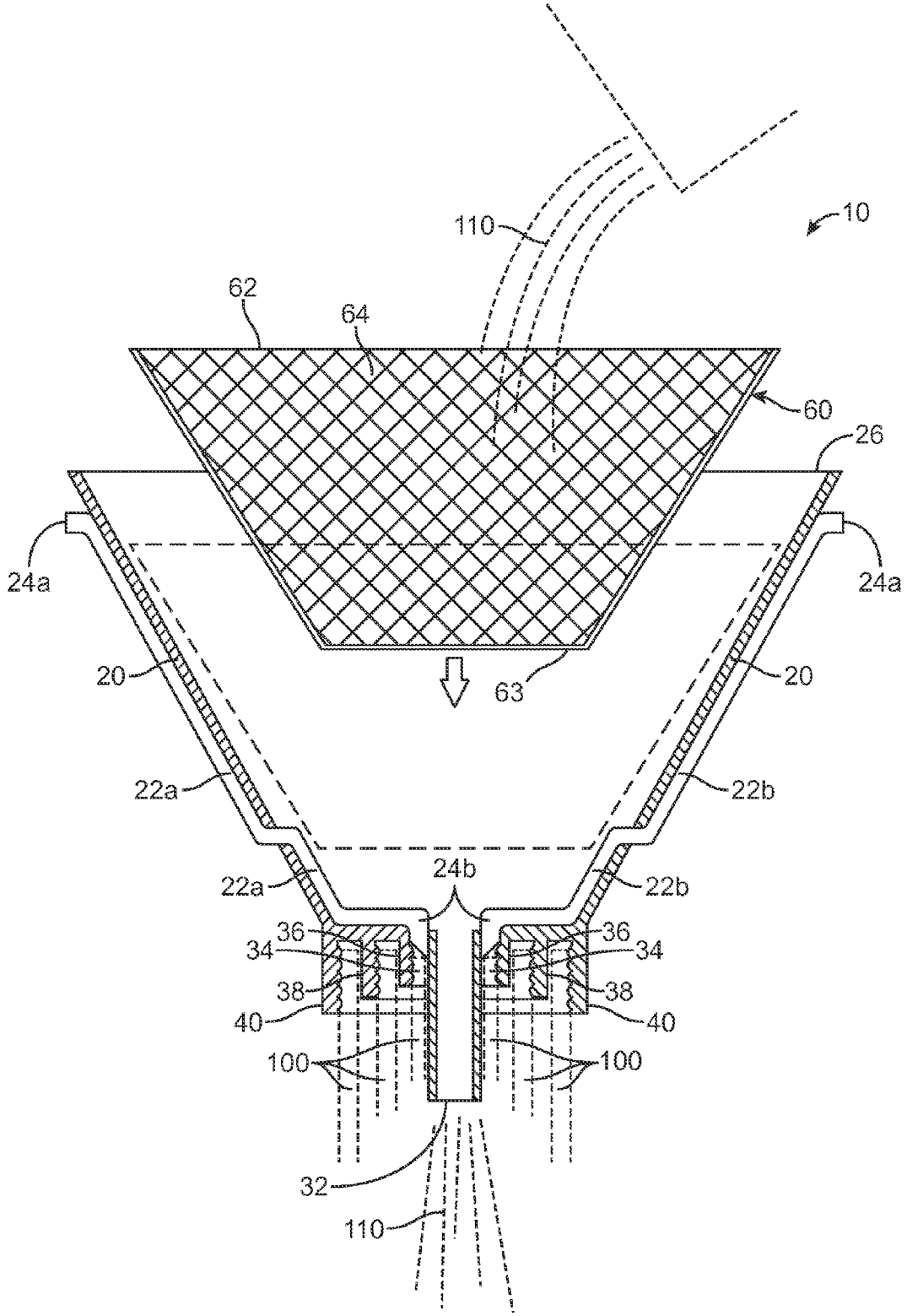
FIG. 2 is a section view of the attachable funnel with internal strainer taken along section line A-A of FIG. 1, in accordance with the present invention; and, FIG. 3 is a bottom plan view of the attachable funnel with internal strainer, in accordance with the present invention.
Figure 3:
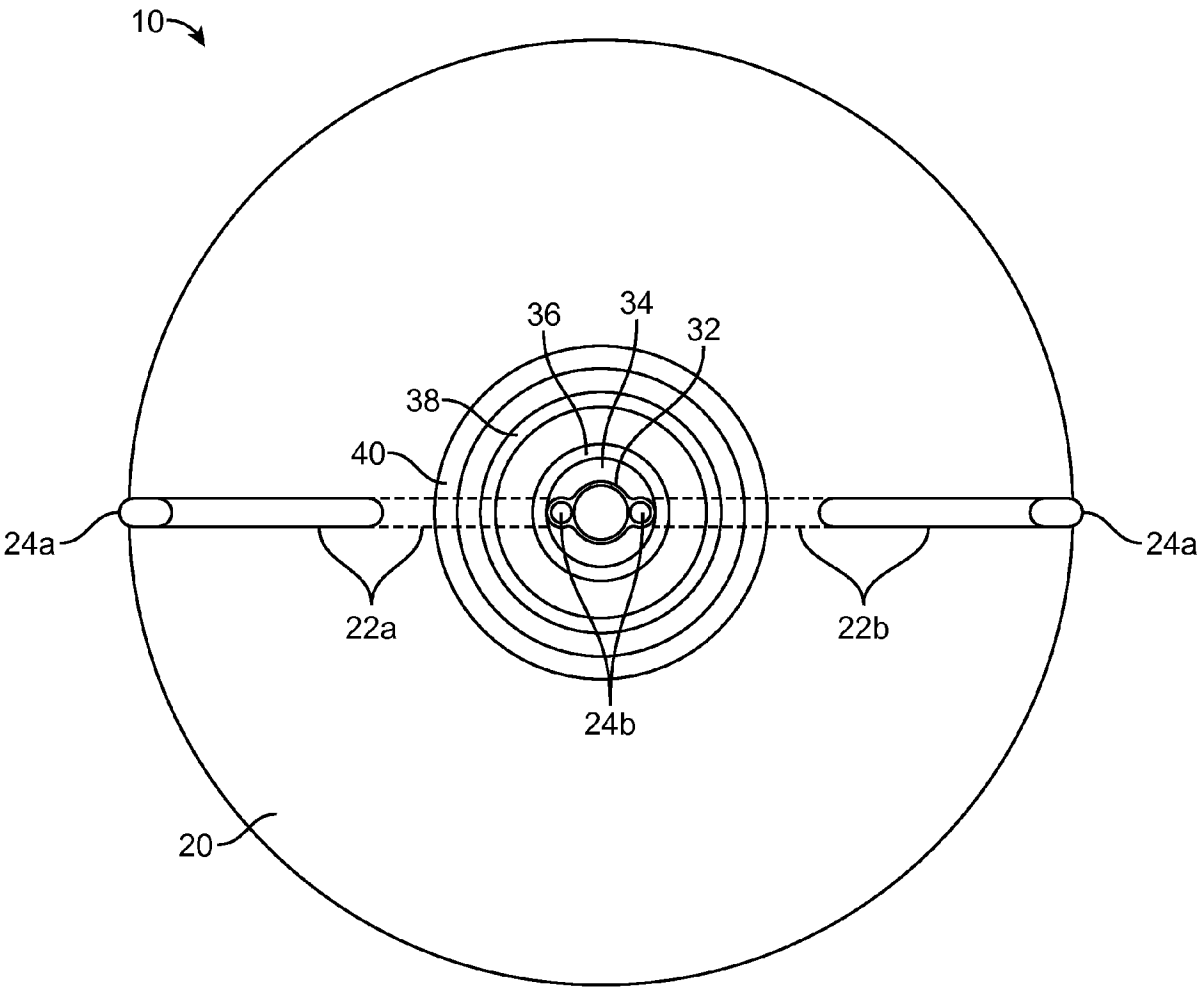

In accordance with the invention, the best mode is presented in terms of certain embodiments, herein depicted within FIGS. 1 through 3. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

It can be appreciated that, although such terms as first, second, etc. may be used herein to describe various elements, these elements should not be limited by these terms. These terms are only used to distinguish one element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 3, depicting an attachable funnel with internal strainer particularly suited for use with fluids, such as cooking oil, that require straining for purposes of reuse. The attachable funnel with internal strainer is identified generally by reference to a device 10, where like reference numerals represent similar or like parts. In accordance with the teachings of the present disclosure, the device 10 generally provides enhanced features which increase convenience during the transfer of fluid into a holding container.

Referring first to FIG. 1, which depicts a partial cut-away side view of the device 10. The device 10 generally includes a tapered funnel body 20 having a wide funnel top opening 26, an integral cylindrical collar 30 disposed along a bottom edge of the funnel body 20, and a downwardly extending spout 32. A screen strainer 60 is insertably attached within the funnel body to remove food particles and other contaminants during transfer of a fluid 110 into a container for storage and reuse. Removal of the strainer 60 allows the device 10 to perform a normal funnel function without straining, if so desired. It can be appreciated that the device 10 can introduced in a variety of scaled sizes suitable for various volumetric fluid transfer tasks. Furthermore, the funnel body 20 and collar 30 are envisioned to be molded in a durable plastic having different colors and patterns.

Referring next to FIGS. 1 through 3, the collar 30 includes a plurality of integrally-molded container attachment rings 36, 38, 40 arranged in a circumscribed manner around the spout 32 which provide for threaded attachment of the device 10 to a threaded mount of a container 100. The matingly threaded attachment securely retains the device 10 in place upon the container 100 while transferring fluids 110 without the risk of tipping or spilling.

Referring next to FIGS. 2 and 3, which more clearly illustrate the plurality of container attachment rings 36, 38, 40. The funnel body 20 is tapered having a generally conical shape. The strainer 60 is also tapered having a generally conical shape suitably sized to fit within the hollow interior region of the funnel body 20 and contact the interior side wall of the funnel body 20. The strainer 60 has a trapezoidal-shaped cross-section having a wide strainer top opening 62 and a mesh strainer bottom 63. The strainer 60 is anticipated to be made of a plastic or stainless-steel open-mesh material 64 having a mesh suitably sized to strain out and retain food particles and other contaminants when preparing the fluid 110 for storage or reuse. The strainer 60 is removably inserted within the funnel body 20 and positioned parallel to respective side wall surfaces of the funnel body 20. During the straining process, the fluid 110 passes through all surfaces of the open-mesh material 64. The strainer 60 is designed for repeated usage and is easily removed and cleaned in a dishwasher.

Referring still to FIGS. 2 and 3, in the exemplary embodiment the collar 30 is illustrated as having a first container attachment ring 36, a second container attachment ring 38, and a third container attachment ring 40 which are circumscribed and each having respective incrementally greater diameters. The incremental increases in diameter of the container rings 36, 38, 40 provide for threaded attachment of the device 10 to correspondingly sized containers 100 each having threaded mouths of differing diameters. Each container attachment ring 36, 38, 40 includes an inward-facing threaded surface capable of threadingly mating and engaging a corresponding threaded mouth of various standard-sized containers 100. Each container attachment ring 36, 38, 40 has a progressively larger height to allow unimpeded connection to smaller and wider mouthed containers 100.

In can be appreciated that the device 10 is not limited to the illustrated embodiment and a particular number of container attachment rings can vary depending on final design and market criteria. The size of the container rings 36, 38, 40 is anticipated to be provided based upon a particular selected size of device 10, a specific size container 100 to be filled having a correspondingly sized threaded mouth, and a user's preference.

Referring again to FIGS. 1-3, the centrally located spout 32 extends downwardly from an open bottom of the funnel body 20 and is in fluid communication with the interior of the funnel body 20 in a conventional manner. Between the spout 32 and the first container attachment ring 36 is annular vent slot 34, which upon attachment of the device 10 to the container 100 is positioned within the mouth of the container 100. The vent slots 34 include a pair of opposing entrance apertures **24*b* in fluid communication with respective vent tubes 22*a*, 22*b*. The vent tubes 22*a*, 22*b* extend from the vent slot 34 to the funnel top opening 26 on opposing sides and are preferably formed between interior and exterior layers of the side walls of the funnel body 20. The vent tubes 22*a*, 22*b* provide for the removal of displaced internal air from the within the attached container 100 during filling with the fluid 110 through the entrance apertures 24*b* and exhausts the air out of respective exit apertures 24*a* positioned along an upper edge of the funnel body 20 about the funnel top opening 26. The vent tubes 22*a*, 22*b* are generally hollow tubular members integrally-molded within side walls of funnel body 20 and are preferably arranged in an opposing manner to each other. The vent tubes 22***a*, 22*b* provides an escape route for air from within the container 100 to escape in an unrestricted manner without bubbling or splashing of the fluid 110.

It can be appreciated by one skilled in the art that other styles and configurations of the present invention can be easily incorporated into the teachings of the present disclosure and only certain particular configurations have been shown and described for purposes of clarity and disclosure and not by way of limitation of scope.

In accordance with the principles of the present invention, the device 10 can be installed and utilized by the user in a simple and effortless manner with little or no training in general accordance with FIG. 1 and FIG. 3. It can be appreciated that the steps required to install and utilize the device 10, as described, can performed in alternative order and as such should not be viewed as a limiting factor.

The method of utilizing the device 10 can be achieved by performing the following steps: procuring a model of the device 10 having a desired size and color; selecting a standard-size container 100 to be filled with a strained fluid 110; attaching the device 10 to the container 100 by threadingly engaging the threaded mouth of the container 100 with a correspondingly sized container attachment ring 36, 38, 40 of the collar 30, until tight; insertably attaching the strainer 60 into the funnel body 20; pouring a volume of the fluid 110, such as cooking oil, into the strainer top opening 62; allowing the fluid 110 to pass through the open-mesh material 64 of the strainer 60, out of the spout 32, and into the container 100; allowing the displaced air from within the container 100 to enter the entrance apertures 24*b*, pass upwardly through the vent tubes 22*a*, 22*b*, and out of the exit apertures 24*a* during filling; continuing to pour the fluid 110 into the device 10 until the container 100 is full or until the supply of fluid 110 is exhausted; and, benefiting from a stable means to transfer and strain fluids 110 into standard containers 100 without experiencing bubbling or splashing afforded a user of the device 10.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A funnel comprising:

a funnel body comprising an open top, a closed bottom, and a continuous side wall configured to receive a fluid;

a spout affixed to said funnel body closed bottom and in fluid communication with an interior of said funnel body to discharge said fluid;

a strainer insertable within said funnel body;

a plurality of circumscribed container attachment rings, each of said plurality of circumscribed container attachment rings being affixed directly to and extending away from said funnel body closed bottom around said spout, and each of said plurality of circumscribed container attachment rings comprising a progressively greater diameter and a threaded inner surface for threaded attachment around a mouth of a container;

an annular vent slot disposed around said spout and in fluid communication with an interior of said container; and at least one hollow vent tube in fluid communication with said annular vent slot and configured to provide a fluid passage way for displaced air from within said container, said at least one hollow vent tube being integral to said funnel body continuous side wall and extending from said annular vent slot to proximate said funnel body open top.

2. The funnel of claim 1, wherein said funnel body continuous side wall comprises a substantially conical shape.

3. The funnel of claim 2, wherein said strainer comprises an open top, a substantially conical strainer side wall, and a strainer bottom interiorly oriented to and axially aligned with said funnel body side wall.

4. The funnel of claim 1, wherein said at least one hollow vent tube comprises an air entrance aperture disposed at a lower end of said at least one hollow vent tube and in fluid communication with said annular vent slot and an air exit aperture disposed at an upper end of said at least one hollow vent tube defining said fluid passage way.

5. The funnel of claim 4, wherein said funnel side wall comprises an interior wall and an exterior wall.

6. The funnel of claim 5, wherein said at least one hollow vent tube is disposed between said funnel side wall interior wall and exterior wall.

7. The funnel of claim 1, wherein said strainer comprises a semi-rigid screen mesh.

8. A funnel comprising:

a funnel body comprising an open top to receive a fluid, a substantially conical continuous side wall, and a closed bottom;

a spout affixed to said funnel body closed bottom and in fluid communication with an interior of said funnel body to discharge said fluid;

a strainer comprising an open top, a substantially conical strainer side wall, and a strainer bottom being insertable within said funnel body interiorly oriented to and axially aligned with said funnel body side wall;

a plurality of circumscribed container attachment rings, each of said plurality of circumscribed container attachment rings being affixed directly to and extending away from said funnel body closed bottom around said spout, and each of said plurality of circumscribed container attachment rings comprising a progressively greater diameter for attachment around a mouth of a container;

an annular vent slot disposed around said spout and in fluid communication with an interior of said container; and at least one hollow vent tube in fluid communication with said annular vent slot and configured to provide a fluid passage way for displaced air from within said container, said at least one hollow vent tube being integral to said funnel body continuous side wall and extending from said annular vent slot to proximate said funnel body open top.

9. The funnel of claim 8, wherein said at least one hollow vent tube comprises an air entrance aperture disposed at a lower end of said at least one hollow vent tube and in fluid communication with said annular vent slot and an air exit aperture disposed at an upper end of said at least one hollow vent tube defining said fluid passage way.

10. The funnel of claim 9, wherein said funnel side wall comprises an interior wall and an exterior wall.

11. The funnel of claim 10, wherein said at least one hollow vent tube is disposed between said funnel side wall interior wall and exterior wall.

12. The funnel of claim 11, wherein each of said plurality of circumscribed container attachment rings comprises a progressively larger length corresponding to said progressively greater diameter.

13. The funnel of claim 12, wherein said annular vent slot is disposed between said spout and an innermost container attachment ring of said plurality of circumscribed container attachment rings.

14. The funnel of claim 11, wherein said collar plurality of circumscribed container attachment rings comprises:

a first container attachment ring circumscribing said spout and comprising a threaded first inner surface for threaded attachment to a small mouth of a first container;

a second container attachment ring circumscribing said first container attachment ring and comprising a length and diameter greater than said first container attachment ring and a threaded second inner surface for threaded attachment to a medium mouth of a second container; and, a third container attachment ring circumscribing said second container attachment ring and comprising a length and diameter greater than said second container attachment ring and a threaded third inner surface for threaded attachment to a large mouth of a third container.

15. The funnel of claim 14, wherein said annular vent slot is disposed between said spout and said first container attachment ring.

* * * * *